United States Patent [19]

Schupack et al.

[11] 4,348,844

[45] Sep. 14, 1982

[54] ELECTRICALLY ISOLATED REINFORCING TENDON ASSEMBLY AND METHOD

[76] Inventors: Morris Schupack, 37 Splitrock Rd., South Norwalk, Conn. 06854; Mario G. Suarez, 117 Sutton Manor, New Rochelle, N.Y. 10905

[21] Appl. No.: 190,178

[22] Filed: Sep. 25, 1980

[51] Int. Cl.[3] ..... E04C 3/10; E04C 5/08

[52] U.S. Cl. ..... 52/230; 52/223 L

[58] Field of Search ..... 52/230, 223 R, 223 L

[56] References Cited

U.S. PATENT DOCUMENTS

| | | | |
|---|---|---|---|
| 2,930,642 | 3/1960 | Howlett | 403/314 |
| 3,212,222 | 10/1965 | Wittfoht | 52/230 |
| 3,293,811 | 12/1966 | Rice | 52/223 L |
| 3,343,808 | 9/1967 | Howlett | 254/133 R |
| 3,449,876 | 6/1969 | Howlett | 52/230 |
| 3,520,032 | 7/1970 | Howlett | 24/122.6 |
| 3,605,361 | 9/1971 | Howlett | 52/223 L |
| 3,646,748 | 3/1972 | Lang | 57/223 |
| 3,935,685 | 2/1976 | Howlett | 52/223 L |
| 3,967,421 | 7/1976 | Dufossez | 52/230 X |
| 4,235,055 | 11/1980 | Schambeck | 52/230 |

*Primary Examiner*—J. Karl Bell

*Attorney, Agent, or Firm*—Manfred M. Warren; Robert B. Chickering; Glen R. Grunewald

[57] ABSTRACT

A reinforcing tendon assembly for use in a concrete structure is disclosed which includes a pair of tendon anchorages, an elongated reinforcing tendon extending between and anchored by the anchorages and an electrically insulating conduit mounted on the tendon and extending between the anchorages. The improvement in the assembly is comprised of electrically insulating anchorage envelopes mounted at each of the anchorages in sealed relation to the conduit. The envelopes extend around the anchorages and isolate the tendon assembly from the concrete structure. Several isolating envelope constructions are disclosed, which include collars that encircle the tendon and are sealed to the tendon conduit and anchorage surrounding portions which extend from the bearing surface side around the outwardly facing side of the anchorage. A method for forming an electrically insolated tendon assembly is also disclosed.

17 Claims, 6 Drawing Figures

ELECTRICALLY ISOLATED REINFORCING TENDON ASSEMBLY AND METHOD

BACKGROUND OF THE INVENTION

A typical concrete reinforcing tendon assembly will include a pair of anchor members which are in spaced-apart relation and have an elongated reinforcing tendon mounted between the tendon anchorages. The tendon will be placed under an axial load, either by pretensioning or post-tensioning, and secured in the tensioned condition by the anchorages. Tensioning of the tendon after formation and setting of the concrete structure in which the assembly is mounted is known as post-tensioning and is used widely in the formation of prestressed concrete structures.

The tendon can take the form of a single wire, strand or bar, secured by the anchorages, or a plurality of these reinforcing elements. It is also common for a concrete structure to include both prestressed and non-prestressed reinforcing elements, and typically these various elements cross and are in metal-to-metal contact with each other.

The presence of metallic concrete reinforcing tendon assemblies in concrete structures creates a substantial potential corrosion problem. Moreover, metal-to-metal contact can, under certain circumstances, create the passage of stray electrical currents through the steel tendon elements as a result of potential differentials that may exist between various parts of the concrete structure. These stray currents, together with any undesirable substances in the concrete that may come into contact with the steel have been known to cause failures due to corrosion, stress corrosion or hydrogen embrittlement of the steel.

Under adverse environmental conditions, for example, use of the concrete structure in sea water, the chloride ions in the water afford an electrolyte that forms a corrosion cell locally or between inter-connected reinforcement. Thus, if the concrete is not impervious enough to the sea water or has cracks large enough to permit the penetration of chloride ions to the steel, and if oxygen is available, corrosion will occur.

The corrosion of steel forms products of corrosion which have a volume of about 10 times the volume of the steel from which the corrosion originated. This creates a large expansive force at the corrosion site that most concretes cannot withstand, and concrete cracking and spalling occurs. Spalling and cracking of the concrete will further lead to extensive corrosion as further steel is exposed in the structure.

Current practice in the concrete post-tensioning industry is to protect post-tensioned concrete reinforcing assemblies from corrosion in one of two distinctive ways. First, an unbonded tendon assembly construction can be employed in which the tendon is coated with a corrosion inhibiting grease-like product and is encased in a sheath or conduit. In the case of a single bar, strand or wire, the sheath or conduit is typically a plastic tube. When the tendon assembly includes a tendon formed by a multiplicity of side-by-side wires, strands or bars, the sheath or conduit is normally a metal duct which is filled with the grease-like corrosion inhibitor. The assembly is referred to as "unbonded" since the corrosion-inhibiting grease is not capable of supporting any of the axial load intermediate of the two tendon anchorages.

The second corrosion-inhibiting practice commonly employed is the use of a bonded tendon assembly structure. The elongated tendon in a bonded construction is encased in a sheath into which a cement grout is injected after the tendon has been tensioned and anchored. When the grout inside the conduit sets, it is capable of transferring the axial tension force in the tendon to the conduit or sheath and from there to the concrete structure. Thus, the tendon is, in effect, bonded to the concrete structure by the corrosion-inhibiting grout inside the sheath.

In both the unbonded and the bonded approaches the protective conduit or sheath around the elongated reinforcing tendon is connected at its ends to the anchorage or to a trumpet which extends from the anchor plate of the anchorage. The trumpet, anchor plate and anchorage assembly, however, are usually formed of steel and, further, are usually mounted in pockets or recesses in the concrete which are later filled with cement mortar or grout after the tendon has been tensioned.

While both the bonded and unbonded corrosion-inhibiting techniques employed in the concrete post-tensioning industry effectively reduce the incidence of corrosion, they do not eliminate corrosion, since the resulting structure includes substantial metallic elements which are exposed to the concrete and its inherent porosity and possibility for cracking. Even when a bonded or unbonded post-tensioned reinforcing assembly is used in combination with epoxy-coated unstressed reinforcing bars or the like, there is still a potential for corrosion.

Another approach to the corrosion problem in connection with reinforced concrete has been attempts to decrease concrete porosity by improved concrete consolidation. Thus, the use of extensive vibration and centrifugal casting to consolidate the concrete in order to reduce porosity and the entrapment of air has been found to be effective in preventing the penetration of chloride ions or similar corrosive materials in the concrete to the steel. Additionally, the thickness or depth at which the steel is recessed from the outside of the concrete structure will also affect corrosion. As the thickness increases, it is less likely that chloride ions will penetrate to the steel for any given concrete porosity. Unfortunately, however, increases in concrete thickness are accompanied by dramatic increases in the weight of the structure, and often by an increased need for reinforcing steel.

Typically, for normal concrete construction a cover of less than about 51 millimeters (2 inches) will tend to experience more corrosion problems. If the concrete is consolidated by centrifugal casting, special vibration, dry mix shotcreting or the like, the coverage can be reduced to about 19 millimeters ($\frac{3}{4}$ inch) or, in some instances, even as low as 12 millimeters ($\frac{1}{2}$ inch). These vibration, special casting and similar techniques, however, are often accompanied by an undesirable increase in cost or are not susceptible for use with many types of structures.

OBJECTS OF THE INVENTION

Accordingly, it is an object of the present invention to provide a reinforcing tendon assembly for use in a concrete structure or the like which assembly is completely electrically isolated from the structure in which it is mounted.

It is a further object of the present invention to provide a method for electrically isolating a reinforcing tendon assembly from the concrete structure in which it is mounted.

A still further object of the present invention is to provide an electrically isolated reinforcing tendon assembly for a concrete structure or the like which is adaptable for use with a wide range of reinforcing tendons and tendon anchorages.

Another object of the present invention is to provide an electrically isolated reinforcing tendon assembly for use in a concrete structure which eliminates the need for specialized concrete consolidation techniques.

Another object of the present invention is to provide an electrically insulating anchorage envelope which can be used in combination with electrically insulating conduit means around an elongated reinforcing tendon to provide an electrically isolated tendon assembly.

Still a further object of the present invention is to provide an electrically isolated tendon assembly, an anchorage envelope means and a method for isolating a tendon assembly which is easy to construct, low in cost, durable, and permits a minimum thickness of concrete covering the tendon assembly.

The electrically isolated reinforcing tendon assembly, anchorage envelope, and method of the present invention have other objects and features of advantage which will become apparent from and are set forth in more detail in the accompanying drawing and following description of the preferred embodiments.

SUMMARY OF THE INVENTION

The concrete reinforcing tendon assembly of the present invention includes a pair of tendon anchorages mounted in relatively spaced-apart relation, an elongated reinforcing tendon extending between the anchorages and electrically insulating conduit means mounted on the tendon. The improvement in the tendon assembly of the present invention is comprised, briefly, of an electrically insulating anchorage envelope means mounted at each of the anchorages in sealed relation to the conduit means with the anchorage envelope means extending around and encasing each of the anchorages and the tendon ends to completely electrically isolate the assembly from the structure in which it is mounted. The electrically insulating anchorage envelope of the present invention includes a body that is formed of an electrically insulating material and has a collar portion formed to encircle the tendon and formed for relative telescoped coaxial alignment with an end of the conduit surrounding the tendon. Additionally, the anchorage envelope means includes an anchorage-surrounding portion formed to extend radially from the collar portion along a bearing surface side of the anchorage and to extend axially to an outwardly facing side of the anchorage. The method of electrically isolating a reinforcing tendon of the present invention is comprised, briefly, of mounting electrically insulating anchorage envelope means on each of the anchorages in a tendon assembly and sealing the envelope means to an electrically insulating conduit mounted on the tendon.

DESCRIPTION OF THE PREFERRED EMBODIMENTS

Although there are numerous examples of reinforcing tendon assemblies which are employed in connection with the post-tensioning of concrete structures, U.S. Pat. Nos. 2,930,642; 3,293,811; 3,343,808; 3,605,361; 3,935,685; 3,449,876 and 3,520,032 are illustrative of anchorages and tendon assemblies used to secure either a single reinforcing bar, strand or wire or, in the case of the latter two patents, a multiplicity of such elongated reinforcing elements. As will be apparent from a review of these patents, it is well known to form a tendon assembly from a pair of tendon anchorages that are mounted in relatively spaced-apart relation in the concrete structure with an elongated tendon extending between the anchorages. Often the anchorages are recessed in pockets in the concrete so that they can subsequently be grouted over (for example, U.S. Pat. No. 3,605,361). Sometimes the elongated reinforcing tendon will be wrapped in a paper or plastic sheath or conduit with grease being applied before wrapping or extruding of the conduit. U.S. Pat. No. 3,646,747 discloses a process for greasing and extruding a plastic sheath or conduit means around multiple wire strand, which conduit is widely used in the concrete post-tensioning industry.

It is recognized that the reinforcing tendon assembly of the present invention includes some elements which are commonly known in the concrete post-tensioning industry; no claim is made to these elements per se. Thus, the use of a pair of tendon anchorages mounted in relatively spaced-apart relation in the concrete structure is well known. This would include the use of a "live" anchorage which can be tensioned and a "dead-end" anchorage to which the tendon is permanently secured and against which the axial load is applied. Similarly, it is also well known in the industry to employ an anchorage at one end of a structure and use a wire or strand which is looped down to the other end of the structure, where it is held by anchorage means, such as a transverse bar, and then return back to the first end of the structure for securement by another tendon anchorage.

Accordingly, as used herein, the expression "tendon anchorage" shall include live anchorages of the type set forth in the above-referenced patents, as well as dead-end anchorages and other means of anchoring or securing an elongated reinforcing element for application of tension forces to that element. Similarly, the expression "tendon" shall include one or more wires, strands, bars or the like, which are conventionally used to reinforce concrete structures. Still further, the expression "concrete structure or the like" shall include conventional concrete as is presently widely used in the post-tensioning industry and the newer synthetic building masses, such as epoxy-based and sulphur-based quick-setting composite materials which are now in the process of development and experimentation.

Figure 1:
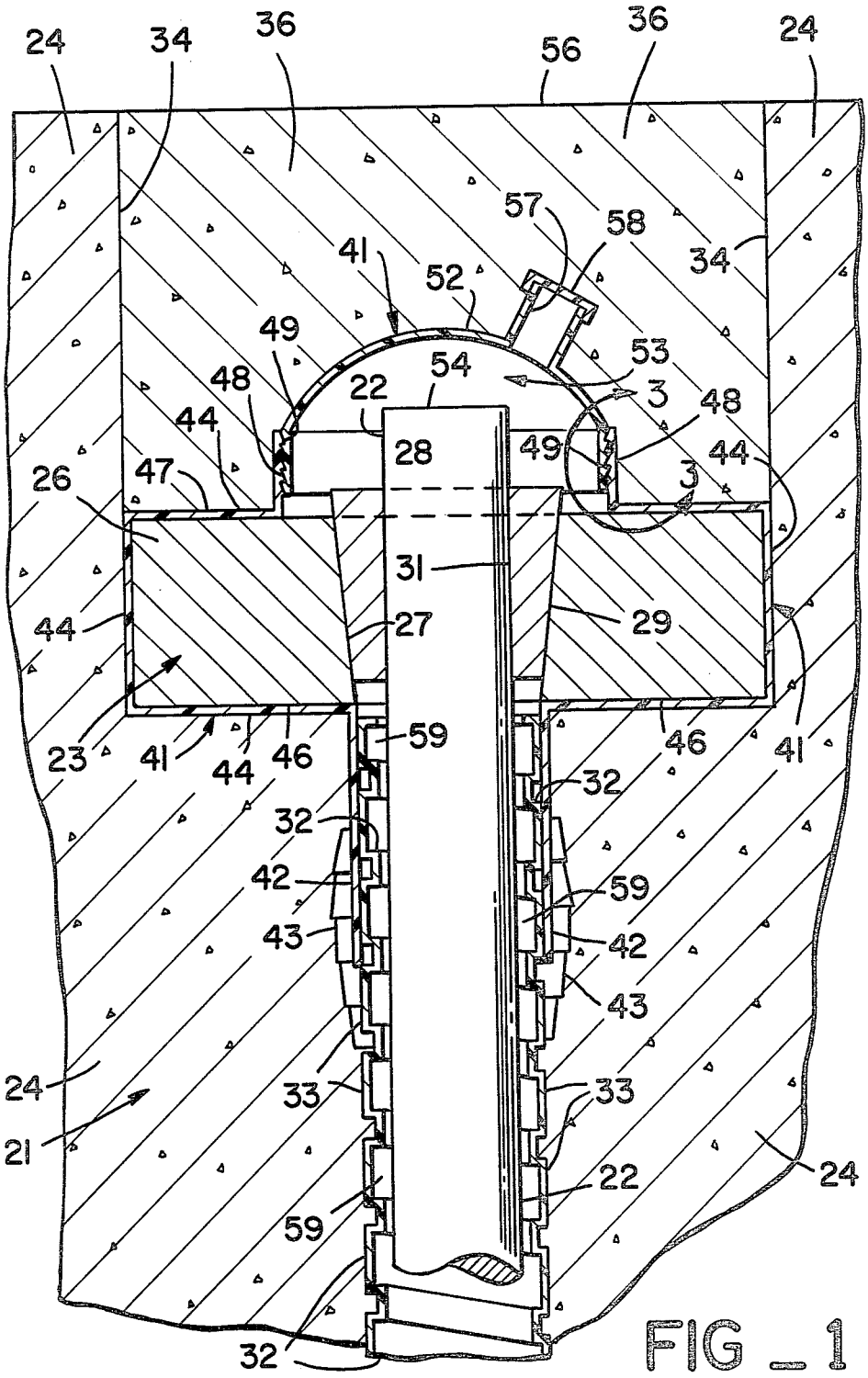
FIG. 1 is a fragmentary, side elevational view in cross-section of a reinforcing tendon assembly constructed in accordance with the present invention and shown installed in a concrete structure.

Referring now to FIG. 1, the improvement in the reinforcing tendon assembly of the present invention can be described in detail. As shown in FIG. 1, one end of a tendon assembly, generally designated 21, is illustrated. The assembly includes a tendon 22, here shown as a bar, which is secured by an anchorage, generally designated 23, in a concrete structure 24. Anchorage 23 is comprised of an anchor plate 26 having a tapered bore 27 in which a wedge assembly 28, having a mating frusto-conical outer surface 29, is positioned. Wedge assembly 28 is conventionally formed of a plurality of wedge segments having an internal central bore 31 formed with serrations or teeth (not shown) which engage or grip tendon 22 as the axial load on the tendon tends to pull the wedge assembly toward the small end of bore 27 in anchor plate 26.

In order to permit axial tensioning of tendon or bar 22 after concrete 24 has set up, and further in order to protect the tendon or bar from corrosion, a longitudinally extending conduit means or sheath 32 is mounted coaxially on bar 22 and will extend from anchorage 23 to the tendon anchorage at the opposite end of the bar and concrete structure. As shown in FIG. 1, conduit means 32 is formed with corrugations or plurality of circumferentially extending ridges 33 which enable grout to be injected between tendon 22 and conduit 32 for the transfer of axial load from the bar to the grout and then to the corrugated conduit and finally to concrete structure 24.

As also shown in FIG. 1, anchorage 23 is recessed in a pocket or cavity 34 which is later filled with grout 36 so that the anchorage is, in effect, buried in the concrete structure for both aesthetic and corrosion-inhibiting reasons.

Although the use of plastic conduit means 32 to surround and encase the elongated tendon 22 is well known in the industry, anchorage 23 has heretofore been exposed to and in full contact with concrete structure 24 and grout cap or plug 36. In the improved concrete reinforcing tendon assembly of the present invention an electrically insulating anchorage envelope means, generally designated 41, is provided. Envelope means 41 is mounted to each of the anchorages in the tendon assembly and is further mounted in sealed relation to conduit means 32, which also must be formed of an electrically insulating material. The anchorage envelope 41 extends around and encases each of the anchorages and the end of the tendon so that the electrically insulating anchorage envelopes in combination with the electrically insulating conduit means completely electrically isolates the tendon assembly from concrete structure 24.

Sealing of envelope 41 to conduit means 32 can be accomplished in a number of different manners. It is preferable, however, to provide envelope 41 with a collar portion 42 formed to extend away from anchorage 23 toward the remaining anchorage. Thus, collar 42 extends from envelope 41 on what is usually the inside or inwardly facing side of the envelope, and the collar is dimensioned for and is mounted in relative coaxial telescoped alignment with conduit means 32 and tendon 22. Collar 42 can be slidably received over conduit 32 or inside the conduit, depending upon the collar and conduit dimensions and the desirability of injecting grout into the space between the conduit and the tendon. As shown in FIG. 1, collar 42 is sealed to conduit 32 by seal means 43, here shown as an electrically insulating adhesive tape that is wound around and overlaps both the collar and the conduit.

The body of anchorage envelope 41 further includes an anchorage surrounding portion 44 that is formed to extend radially from collar portion 42 along a bearing surface side 46 of anchor plate 26. The anchorage-surrounding portion 44 of the envelope body further extends axially in the direction of the tendon 22 to an outwardly facing side 47 of the anchorage. As shown in FIG. 1, the surrounding portion 44 of envelope 41 then extends radially inwardly to annular flange 48 which includes fastener means 49 formed for securement of at least one of a construction joint form (shown in the form of the tendon assembly of FIG. 2) and an anchorage protection housing portion 52.

Housing portion 52 of the anchorage envelope is formed to extend away from the outwardly facing side 47 of the anchorage and is dimensioned to define a cavity 53 between housing portion 52 and anchorage 23 for receipt and enclosure of the tendon-gripping mechanism, such as wedge assembly 28, and the end 54 of the tendon. Thus, the anchorage protection housing portion of the envelope completes the encasement and surrounding of the anchorage, even from the grout cap or plug 36.

Formation of a concrete structure 24 having a reinforcing tendon assembly as shown in FIG. 1 would normally be accomplished in the following manner. First, anchorage 23, with anchorage envelope 41 mounted thereon, would be placed, usually by forms which will be described in more detail in connection with FIG. 2, prior to pouring of the concrete 24. Bar 22 would be positioned through the tapered bore 27 of the anchor plate, and the conduit taped or otherwise sealed to collar 42 of the envelope. The wedge assembly would not initially be placed in the anchorage and bar 22 would extend out of pocket 34 beyond the eventual outside surface 56 of the concrete structure. Obviously, the housing or dome portion 52 of the envelope would not be mounted to the remainder of the envelope. Forms (not shown) would be used to form the pocket and the remainder of the concrete structure.

After the concrete had set up, the form boards would be removed, and wedge assembly 28 would be inserted into bore 27. The bar would then be tensioned by a jack or ram, with the opposite end of the bar being similarly tensioned or merely secured by another tendon anchorage. During the tensioning process, the jack or ram urges the wedge assembly 28 toward the small diameter end of the bore while pulling on the tendon, and when the tension forces were relaxed slightly, the wedge assembly will pick up the entire axial load of the bar. After the bar is tensioned, it can be sheared or otherwise cut off at end 54 and housing or dome portion 52 fastened by fastening means 49 to the remainder of anchorage envelope 41. Once the dome or housing portion is in place, the grout cap or plug can be poured and allowed to set up.

It is preferable that the housing portion or dome 52 include an opening, such as a tubular port 57, which can be provided with a cap or closure means 58. If the tendon is to be bonded over its length, grout will be injected through opening 57 into the inside of housing 52 and will pass along the slots in the wedge assembly (defining the wedge segments) and further down along the space 59 between the tendon and conduit 32. Once the full length of the conduit has been grouted, cap 58 can be sealed to the tubular injection port 57 and the end plug of grout 36 poured into pocket 34. As will be appreciated, an opposite end of conduit 32 will normally include a similar port for escape of the air from the space 59 between the tendon and conduit.

Figure 3:
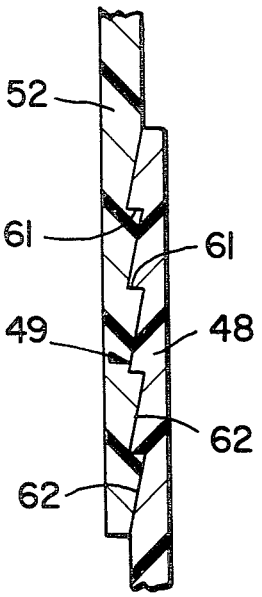
FIG. 3 is an enlarged, fragmentary side elevational view of a snap-acting coupling suitable for use in the area bounded by the line 3—3 of FIG. 1.
Figure 4:
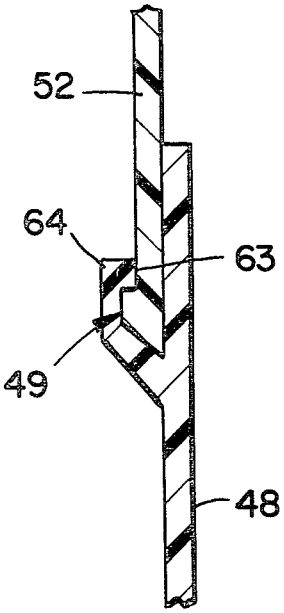
FIG. 4 is an enlarged, fragmentary, side elevational view in cross-section of a modified form of the snap-acting coupling of FIG. 3.

Fastening of the housing portion of the anchorage envelope to the remainder of the envelope can be accomplished in a number of different manners. As shown in FIGS. 3 and 4, mating interfitting shoulder means formed for snap-acting interengagement is preferably provided. In FIG. 3, fastening means 49 is provided by a plurality of shoulders 61 facing in opposite directions and interconnected by tapering surfaces 62. As shown in FIG. 4, a shoulder 63 engages an oppositely facing shoulder on radially inwardly displaceable lip 64 to secure the housing to the remainder of the envelope.

Figure 2:
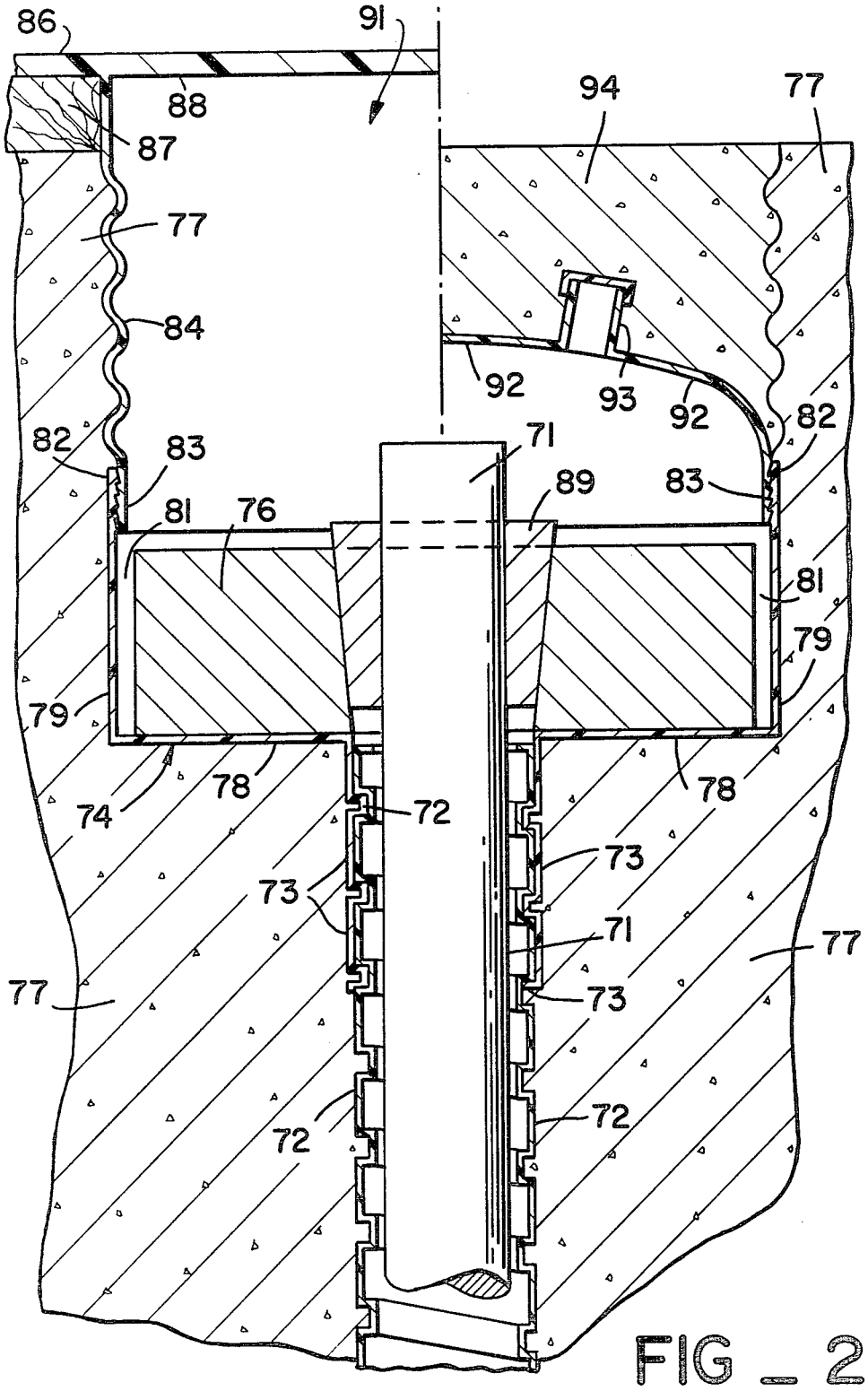
FIG. 2 is a fragmentary, side elevational view in cross-section of a modified form of the reinforcing tendon assembly of the present invention with the left side of the figure shown before grouting and the right side of the figure shown after grouting and removal of the forms.

In FIG. 2 a modified form of the reinforcing tendon assembly of the present invention is illustrated. As is the case with the previously described form of the tendon assembly, tendon or bar 71 is surrounded by an electrically insulating conduit or sheath 72 which is corrugated to permit bonding of the tendon if desired. Extending inwardly along conduit means 72 is a collar portion 73 of the anchorage envelope, generally designated 74. Collar portion 73 is here shown with corrugations that mate with the corrugations in conduit 72. Additionally, the conduit corrugations are preferably formed with a lead or a screw-type thread so that the collar 73 can be screwed down on and will seal against the thread-like corrugations in conduit 72.

In order to permit placement of anchor plate 76 in the assembly after pouring of concrete 77, the anchorage envelope of the present invention is formed with a body in which the surrounding portion 78, and particularly the axially extending sides 79, are formed and dimensioned to permit insertion and withdrawal of the anchorage and anchor plate 76. As will be seen, therefore, there is a space 81 between the sides of the anchor plate and the axially extending portions 79 of the surrounding envelope. In the form of the invention shown in FIG. 1, surrounding portion 44 of the envelope is in mating engagement and tight fit with the tendon anchorage. In effect, in the form of the invention in FIG. 1, the surrounding portion is in a shrink fit with the anchor plate, while in FIG. 2 it is loosely fitting to permit insertion of the anchor plate to bear against the anchorage envelope.

In FIG. 2, the upper end 82 of anchorage-surrounding portion 78 is formed with fastener means 83 to which a construction joint form 84 can be releasably secured. Form 84 includes an outer section 86 that can be secured to form board 87 for casting of the concrete member 77. Additionally, the form 84 includes a transverse end portion 88.

Placement of the anchorage in the concrete structure is accomplished by threading the collar 73 onto conduit 72, securing the form member 84 to the upper end 82 of the anchorage envelope and to form board 87, and then pouring the concrete 77 and allowing the same to set up. The anchor plate 76 and wedge assembly 89 are not positioned in the pocket 91 formed by form member 84 so as to minimize the exposure of the anchor plate and wedge assembly to corrosion and contaminants during the concrete pouring process.

After the concrete has set up, form 84 can be removed, as will be form board 78, and then the anchor plate and wedge assembly will be inserted into pocket 91 and positioned around tendon 71. The end of tendon 71 will normally extend out of the pocket to permit tensioning and will be sheared off once the tendon is tensioned. After tensioning of the tendon, the complete enclosure of the anchorage is accomplished by mounting dome-shaped housing portion 92 to fastener means 83 on the upper end 82 of the envelope. The anchorage can then be grouted, if desired, through grout port 93 and an end cap or plug 94 of grout can be poured over the housing portion to fill the remainder of pocket 91 above housing 92. The resultant grouted-in anchorage is shown on the right-hand side of FIG. 2.

Figure 5:
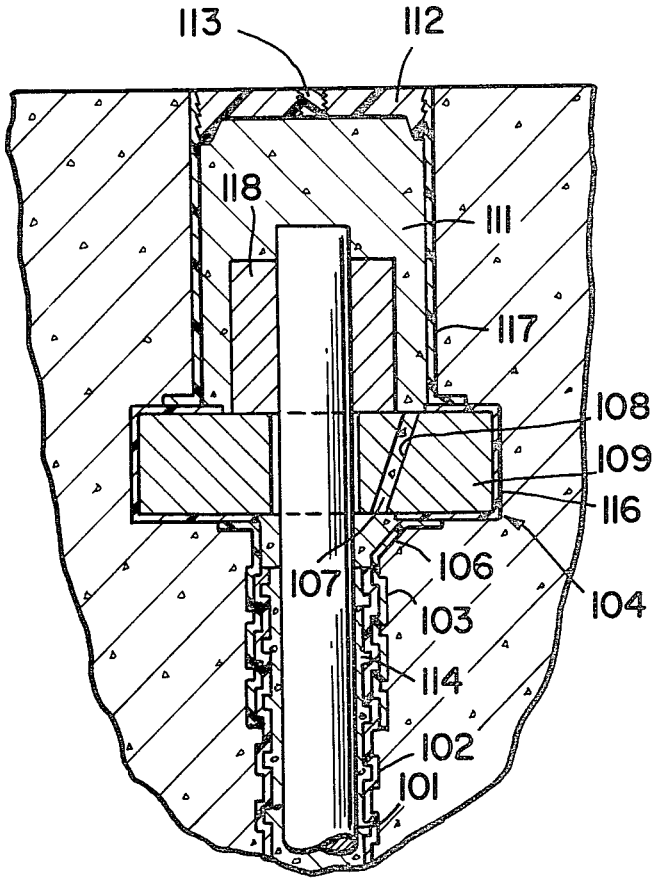
FIG. 5 is a fragmentary, side elevational view in cross-section and reduced scale of a further modified form of the reinforcing tendon assembly of the present invention.

In FIG. 5 a further modified form of the tendon assembly of the present invention is shown. In this form of the tendon assembly and electrically insulating anchorage envelope, tendon 101 is surrounded by corrugated conduit 102, which in turn has corrugated collar portion 103 of the electrically insulated anchorage envelope of the present invention threadably mounted thereon. The collar portion of the anchorage envelope, generally designated 104, is formed with a flared section 106 which extends radially outwardly from tendon 101 a sufficient distance to enclose the output port 107 of a grout passageway 108 to anchor plate 109. This construction permits grout to be injected into the cavity 111 through an injection opening in transverse end wall 112 that is subsequently filled by closure means 113. As grout is injected into cavity 114, it migrates through the passageway 108 in the anchor plate to the annular space 114 between tendon 101 and sheath 102.

In the form of the invention shown in FIG. 5, collar portion 106 is formed as a separate member or element from surrounding portion 116 of the electrically insulating envelope. Similarly, the pocket-forming flange or collar 117 is formed as a separate element or member, with portions 117 and collar 106 being bonded or adhesively sealed to the surrounding portion 116.

In some applications, the collar 117 can be left in place in the structure with transverse end member 112 threadably mounted to collar 117. The removal of the transverse end portion is required in order to permit insertion of anchorage nut or wedge assembly, schematically shown at 118. The anchorage mechanism at 118 can take a variety of forms, including a nut which is threaded onto the bar or a wedge-type anchorage of the type disclosed in U.S. Pat. No. 2,930,642.

Figure 6:
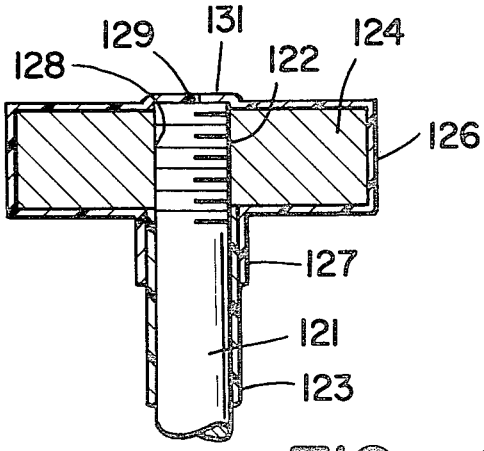
FIG. 6 is a fragmentary, side elevational view in cross-section of a further modified form of the reinforcing tendon assembly of the present invention.

In FIG. 6, a form of the tendon assembly and electrically insulating envelope suitable for use on a "dead-end" anchorage is shown. The tendon 121 is formed with a threaded end 122 and is surrounded by an uncorrugated conduit or sheath 123. Anchor plate 124 has a shrink-fit anchorage envelope 126 mounted thereto which includes a collar portion 127 that is bonded to conduit 123.

In order to permit tendon 121 to be secured to anchor plate 124 with a minimum potential for corrosion or contamination, the threaded bore 128 of the anchor plate will have a fluid adhesive material placed in it before threading of the bar end into the plate. As the bar is threaded into the plate, the excessive adhesive will be urged axially out a pinhole opening 129 in the transverse wall 131 of the envelope. When the bar is fully threaded into the bore 128, the excess adhesive will be driven out of port 129 and will also seal or set up in port 129 so that the anchorage and tendon are not exposed to or in contact with the concrete which is poured around the anchorage.

It is believed that the anchorage envelope of the present invention can be formed of several kinds of electrically insulating materials. The most suitable would be a plastic material having strength in compression since the anchorage envelope on the bearing surface side of the anchor plate (side 46 in FIG. 1) will be subjected to the full axial load of the tendon. The plastic material, therefore, cannot be so thick or poor in compression that the axial load on the bearing plate will extrude or squeeze out the envelope between the bearing surface side of the plate and the concrete. The thickness of the envelope in order to maintain its integrity will depend upon the material used as well as the compression load, which is a function of the axial load and the surface area of the bearing surface side of the anchor plate. The axial load, in turn, will depend upon the number and type of reinforcing elements comprising the elongated tendon. When multiple strands are employed, for example, the axial load can become substantial, although the bearing plate surface area will also be larger.

In order to enhance the capability of the electrically insulating anchorage envelope to withstand compression forces on the bearing surface side of the anchorage, it is contemplated that reinforcing means, such as fibers or the like, may be embedded in the plastic, either throughout the envelope or only along the bearing surface side of the envelope. Thus, fiber-reinforced plastics which are moldable to form corrugated collars and can be shrink-fit onto anchorages and provided with fastener means, such as is shown in FIGS. 3 and 4, are well within the state of the art.

Although testing has not been completed, it is believed that the electrically insulating anchorage envelope of the present invention can be formed of plastic such as ABS, polycarbonates and high-density polyethylene.

What is claimed is:

1. A reinforcing tendon assembly for use in a concrete structure or the like, said assembly including a pair of tendon anchorages mounted in relatively spaced-apart relation in said structure, an elongated reinforcing tendon extending between and anchored by said anchorages, and electrically insulating conduit means mounted on said tendon and extending between said anchorages, wherein the improvement in said tendon assembly is comprised of:

an electrically insulating anchorage envelope means mounted at each of said anchorages in sealed relation to said conduit means, said anchorage envelope means extending around and encasing each of said anchorages and said tendon to completely electrically isolate said tendon assembly from said structure.

2. A reinforcing tendon assembly as defined in claim 1 wherein, at least one of said anchorage envelope means includes collar portion formed to extend away from one of said anchorages toward a remainder of said anchorages, said collar portion being dimensioned for and being mounted in relative coaxial telescoped alignment with said conduit means.

3. A reinforcing tendon assembly as defined in claim 2 wherein, said collar portion and said conduit means are formed with mating thread means and are mounted in sealed relation by threadable engagement of said collar portion with said conduit means.

4. A reinforcing tendon assembly as defined in claim 2, and electrically insulating seal means extending around both said collar portion and said conduit means to provide a seal therebetween.

5. A reinforcing tendon assembly as defined in claim 2 wherein, said collar portion is formed as a separate member and is bonded to a remainder of said anchorage envelope means and is sealed to said conduit means.

6. A reinforcing tendon assembly as defined in claim 1 wherein, at least one of said anchorage envelope means includes an anchorage protection housing portion extending away from said anchorage on an outwardly facing side thereof and dimensioned to define a cavity between said housing portion and said anchorage sufficient for receipt and enclosure of the tendon-gripping mechanism of said anchorage and the end of said tendon.

7. A reinforcing tendon assembly as defined in claim 6 wherein, said housing portion is mounted in sealed relation to the remainder of said anchorage envelope means.

8. A reinforcing tendon assembly as defined in claim 7 wherein, said housing portion includes an opening therein dimensioned for the injection of grout therethrough, and closure means mounted in sealed relation to said opening.

9. A reinforcing tendon assembly as defined in claim 7 wherein, said housing portion and said remainder of said anchorage envelope means are provided with mating interfitting shoulder means formed for snap-acting interengagement to produce a seal therebetween.

10. Electrically insulating anchorage envelope means for use in forming an electrically isolated reinforcing tendon assembly in a concrete structure or the like; said tendon assembly including a tendon anchorage, a tendon secured by said anchorage, and electrically insulating conduit means mounted on said tendon; and said anchorage envelope means comprises:

an envelope body formed of an electrically insulating material and having:

(i) a collar portion formed to encircle said tendon and formed for relative telescoped coaxial alignment with an end of said conduit means; and (ii) an anchorage surrounding portion formed to extend radially from said collar portion along a bearing surface side of said anchorage and to extend axially to an outwardly facing side of said anchorage.

11. Electrically insulating anchorage envelope means as defined in claim 10 wherein, said anchorage-surrounding portion includes fastener means formed for securement at least one of a construction joint form and an anchorage protection housing portion thereto.

12. Electrically insulating anchorage envelope means as defined in claim 11, and an anchorage protection housing portion formed of an electrically insulating material and secured to said anchorage surrounding portion by said fastening means, said housing portion extending away from said outwardly facing side of said anchorage and being dimensioned to define a cavity between said housing portion and said anchorage for receipt and enclosure the tendon-gripping mechanism of said anchorage and the end of said tendon.

13. Electrically insulating anchorage envelope means as defined in claim 11, and a construction joint form secured to said surrounding portion and formed to define a pocket in said structure for access to said anchorage.

14. Electrically insulated anchorage envelope means as defined in claim 10 wherein, said anchorage-surrounding portion is formed and dimensioned to permit insertion and withdrawal of said anchorage therefrom.

15. Electrically insulated anchorage envelope means as defined in claim 10 wherein, said anchorage-surrounding portion is formed for mating engagement with said anchorage.

16. Electrically insulating anchorage envelope means as defined in claim 10 wherein, said anchorage-surrounding portion includes a bearing surface portion formed for positioning between the axial load-bearing surface of said anchorage and said structure, said bearing surface portion being formed of an electrically insulating material having reinforcing means embedded therein.

17. A method of electrically isolating a reinforcing tendon assembly from a concrete or similar structure in which it is mounted, said method including the steps of mounting a pair of tendon anchorages in spaced-apart relation in said structure, and securing exposed sections of a reinforcing tendon having electrically insulating conduit means mounted thereon by engaging said sections with said anchorages, wherein the improvement in said method is comprised of:

mounting electrically insulating anchorage envelope means on each of said anchorages, said envelope means being formed to surround and electrically isolate said anchorages from said structure, and substantially sealing said envelope means to said conduit means.

* * * * *